US005271062A

United States Patent [19]

Sugita et al.

[11] Patent Number: 5,271,062

[45] Date of Patent: Dec. 14, 1993

[54] DEVICE FOR NOISE ATTENUATION OF WEAVING MACHINE

[75] Inventors: Katsuhiko Sugita; Tsutomu Sainen, both of Ishikawa, Japan

[73] Assignee: Tsudakoma Kogyo Kabushiki Kaisha, Japan

[21] Appl. No.: 848,383

[22] Filed: Mar. 9, 1992

[30] Foreign Application Priority Data

Mar. 27, 1991 [JP] Japan ..... 3-85931

[51] Int. Cl.[5] ..... G10K 11/16

[52] U.S. Cl. ..... 381/71

[58] Field of Search ..... 381/71, 94

[56] References Cited

U.S. PATENT DOCUMENTS

| | | | |
|---|---|---|---|
| 4,506,380 | 3/1985 | Matsui | 381/86 |
| 4,689,821 | 8/1987 | Salikuddin et al. . | |
| 4,862,506 | 8/1989 | Landgarten et al. | 381/71 |
| 4,947,435 | 8/1990 | Taylor | 381/71 |
| 5,111,507 | 5/1992 | Nakaji | 381/71 |

FOREIGN PATENT DOCUMENTS

| | | |
|---|---|---|
| 51-102154 | 9/1976 | Japan . |
| 58-113790 | 8/1983 | Japan . |
| 59-9699 | 1/1984 | Japan . |
| 61-112496 | 5/1986 | Japan . |
| WO90/09655 | 8/1990 | PCT Int'l Appl. . |
| WO90/13109 | 11/1990 | PCT Int'l Appl. . |
| 2107960A | 5/1983 | United Kingdom . |
| 2149614A | 6/1985 | United Kingdom . |

*Primary Examiner*—Forester W. Isen

*Attorney, Agent, or Firm*—Graybeal Jackson Haley and Johnson

[57] ABSTRACT

A device for noise attenuation attenuates the noises generated from weaving machines and comprises first conversion means for receiving a sound and outputting an electrical acoustic signal corresponding to the sound, first signal processing means for receiving the acousto-electric signal and outputting a first electrical signal having the frequency and amplitude corresponding to a sound to be attenuated on the basis of the received acoustic-electric signal, second signal processing means for receiving the first electrical signal and outputting a second electrical signal having the same frequency and inverted phase relative to the first electrical signal, and second conversion means for receiving the second electrical signal and generating a sound corresponding to the received second electrical signal.

9 Claims, 8 Drawing Sheets

FIG. 2($B_1$) ...

FIG. 2($C_1$) ...

FIG. 5

| n | θ | PEAK 1 (E1) | PEAK 2 (E2) | | PEAK I (E1) |
|---|---|---|---|---|---|
| 1 | θ1 | f111 | f211 | | f111 |
| 1 | θ2 | f112 | f212 | | f112 |
| ⋮ | ⋮ | ⋮ | ⋮ | | ⋮ |
| 1 | θm | f11m | f21m | | f11m |
| 2 | θ1 | f121 | f221 | | f121 |
| 2 | θ2 | f122 | f222 | | f122 |
| ⋮ | ⋮ | ⋮ | ⋮ | | ⋮ |
| 2 | θm | f12m | f22m | | f12m |
| | | | ⋮ | | |
| n | θ1 | fn1 | f2n1 | | fn1 |
| n | θ2 | fn2 | f2n2 | | fn2 |
| ⋮ | ⋮ | ⋮ | ⋮ | | ⋮ |
| n | θm | fnm | f2nm | | fnm |

...

DEVICE FOR NOISE ATTENUATION OF WEAVING MACHINE

BACKGROUND OF THE INVENTION

1. Field of the Invention

This invention relates to a device for attenuating noise generated from weaving machines.

2. Description of the Prior Art

Noises with various frequency components are generated from weaving machines. Therefore, conventionally, some noise-insulating functions are given to the installation spaces for the weaving machines, such as floors, walls and ceilings which define weaving machine rooms, and in this manner, the noise is prevented from leaking out of the installation space. However, the noise within the installation spaces for the weaving machines cannot be attenuated by such a technique.

SUMMARY OF THE INVENTION

An object of the present invention is to provide a device for noise attenuation of weaving machines, which can attenuate the noise within the installation spaces for the wearing machines.

A device for noise attenuation of weaving machines according to the present invention comprises first conversion means for receiving a sound and outputting an acousto-electric signal corresponding to the sound, first signal processing means for receiving the acousto-electric signal and outputting a first electrical signal having the corresponding frequency and amplitude to the sound to be attenuated on the basis of the received acousto-electric signal, second signal processing means for receiving the first electrical signal and outputting a second electrical signal having the same frequency and the inverted phase relative to the first electrical signal, and second conversion means for receiving the second electrical signal and generating a sound corresponding to the received second electrical signal.

The device for noise attenuation is installed to, for example, weaving machines or in the neighborhood thereof. Of all the noises generated from the weaving machines, an acoustic wave corresponding to the first electrical signal is cancelled or attenuated by an acoustic wave corresponding to the second electrical signal, since the second electrical signal has the same frequency and an inverted phase relation to the first electrical signal. For this reason, according to the present invention, the noise within the installation space for the weaving machines can be attenuated.

The device for noise attenuation further comprises means for setting the frequency of the first electrical signal outputted from the first signal processing means.

Instead of the above-mentioned structure, either of the following may be constructed.

The device for noise attenuation further comprises first signal generation means for generating an electrical timing signal corresponding to the angle of rotation of a main shaft of a weaving machine, third signal processing means for receiving the acousto-electric signal and the timing signal and outputting a third electrical signal corresponding to the frequency and amplitude of the acousto-electric signal by relating the third electrical signal with the timing signal, fourth signal processing means for receiving the outputting signal of the third signal processing means and outputting a fourth electrical signal specifying the frequency of a sound to be attenuated in the acousto-electric signal by relating the fourth electrical signal with the timing signal, and fifth signal processing means for receiving the outputting signal of the fourth signal processing means, storing the fourth electrical signal by relating the fourth electrical signal with the timing signal, reading out the fourth electrical signal on the basis of the timing signal and outputting the read-out fourth electrical signal to the first signal processing means. In this case, the frequency of the first electrical signal outputted from the first signal processing means is specified by the fourth electrical signal outputted from the fifth signal processing means.

The device for noise attenuation further comprises first signal generation means for generating an electrical timing signal corresponding to the angle of rotation of a main shaft of a weaving machine, third signal processing means for receiving the acousto-electric signal and outputting a third electrical signal of a predetermined frequency component in the received acousto-electric signal, fourth signal processing means for receiving the third electrical signal and the timing signal and outputting a fourth electrical signal specifying a frequency corresponding to a sound to be attenuated in the acousto-electric signal by relating the fourth electrical signal with the timing signal, and fifth signal processing means for receiving the outputting signal of the fourth signal processing means, storing the fourth electrical signal by relating the fourth electrical signal with the timing signal, reading out the fourth electrical signal on the basis of the timing signal and outputting the read-out fourth electrical signal to the first signal processing means. In this case, the frequency of the first electrical signal outputted from the first signal processing means is specified by the fourth electrical signal outputted from the fifth signal processing means.

The device for noise attenuation further comprises first signal generation means for generating an electrical timing signal corresponding to the angle of rotation of the main shaft of a weaving machine, means for setting the repeat number of a woven pattern, second signal generation means for receiving the timing signal and the repeat number and generating an electrical step number signal corresponding to the step number of the woven pattern, third signal processing means for receiving the acousto-electric signal, the timing signal and step number signal and outputting a third electrical signal corresponding to the frequency and amplitude of the acousto-electric signal by relating the third electrical signal with the timing signal and the step number signal, fourth signal processing means for receiving the outputting signal of the third signal processing means and outputting a fourth electrical signal specifying the frequency of a sound to be attenuated in the acousto-electric signal by relating the fourth electrical signal with the timing signal and the step number signal, and fifth signal processing means for receiving the outputting signal of the fourth signal processing means, storing the fourth electrical signal by relating the fourth electrical signal with the timing signal and the step number signal, reading out the fourth electrical signal on the basis of the timing signal and the step number signal and outputting the read-out fourth electrical signal to the first signal processing means. In this case, the frequency of the first electrical signal outputted from the first signal processing means is specified by the fourth electrical signal supplied from the fifth signal processing means.

The device for noise attenuation further comprises first signal generation means for generating an electrical timing signal corresponding to the angle of rotation of a main shaft of a weaving machine, means for setting the repeat number of a woven pattern, second signal generation means for receiving the timing signal and the repeat number and generating an electrical step number signal corresponding to the step number of the woven pattern per one rotation of the main shaft, third signal processing means for receiving the acousto-electric signal and outputting a third electrical signal of a predetermined frequency component in the received acousto-electric signal, fourth signal processing means for receiving the third electrical signal, the timing signal and the step number signal and outputting a fourth electrical signal specifying the frequency corresponding to a sound to be attenuated in the acousto-electric signal by relating the fourth electrical signal with the timing signal and the step number signal, and fifth signal processing means for receiving the outputting signal of the fourth signal processing means, storing the fourth electrical signal by relating the fourth electrical signal with the timing signal and the step number signal, reading out the fourth electrical signal on the basis of the timing signal and the step number signal, and outputting the read-out fourth electrical signal to the first signal processing means. In this case, the frequency of the first electrical signal outputted from the first signal processing means is specified by the fourth electrical signal supplied from the fifth signal processing means.

BRIEF DESCRIPTION OF THE DRAWINGS

The foregoing and other objects and features of the invention will become apparent from the following description of preferred embodiments of the invention with reference to the accompanying drawings, in which:

FIG. 5 is a view showing the waveform of an output signal of an objective frequency analysis circuit in the device shown in FIG. 3;

DETAILED DESCRIPTION OF THE PREFERRED EMBODIMENTS

Figure 1:
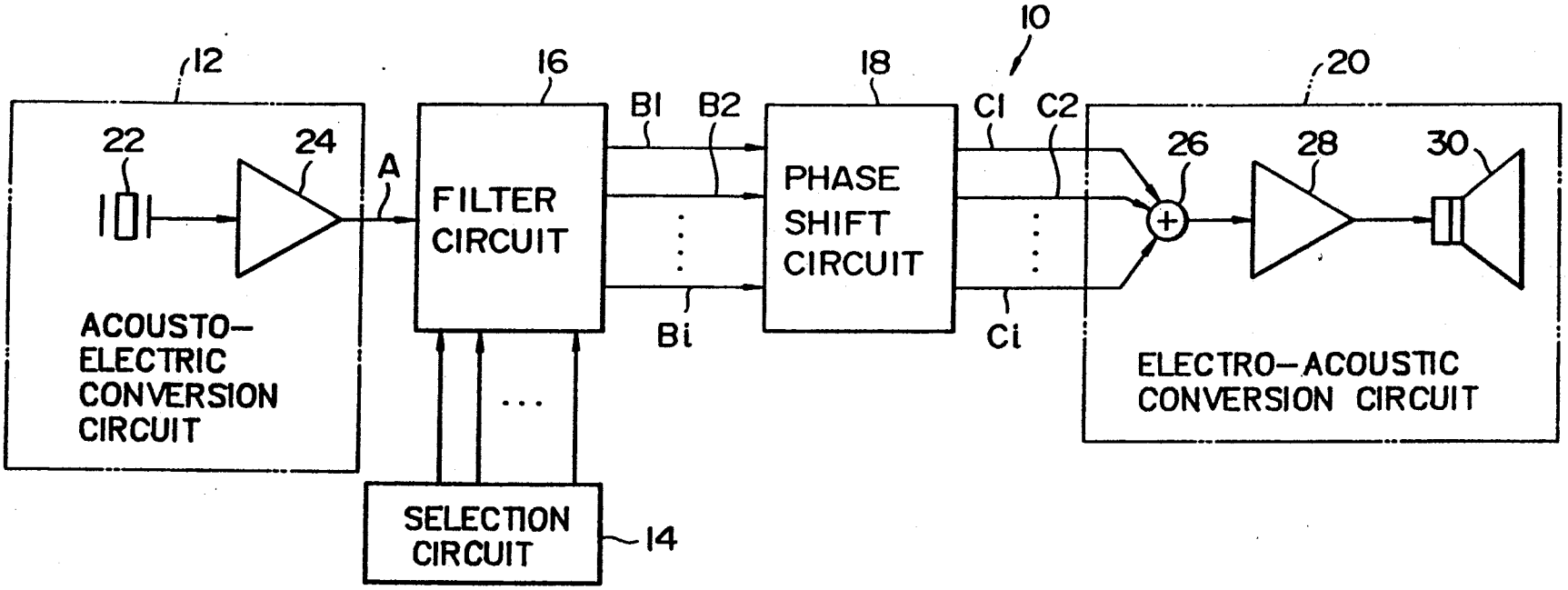
FIG. 1 is a block diagram showing an electrical circuit of a device for noise attenuation as a preferred embodiment of the present invention.

Referring to FIG. 1, a device for noise attenuation 10 comprises first conversion means, that is, an acousto-electric and electrical conversion circuit 12 for outputting an acoustic-electric signal corresponding to a sound generated by a weaving machine, a frequency setting circuit 14 for selection the frequency of an acoustic wave to be attenuated, first signal processing means, that is, a filter circuit 16 for outputting an electrical signal having the frequency and amplitude of a signal corresponding to the frequency set in the selection circuit 14 in the acoustic-electric signal, second signal processing means, that is, a phase-shift circuit 18 for outputting an electrical signal having the same frequency and inverted phase corresponding to the outputting signal of the filter circuit 16, and second conversion means, that is, an electric-acoustic conversion circuit 20 for generating a sound corresponding to the outputting signal of the phase-shift circuit 18.

Figures 2, 2A:
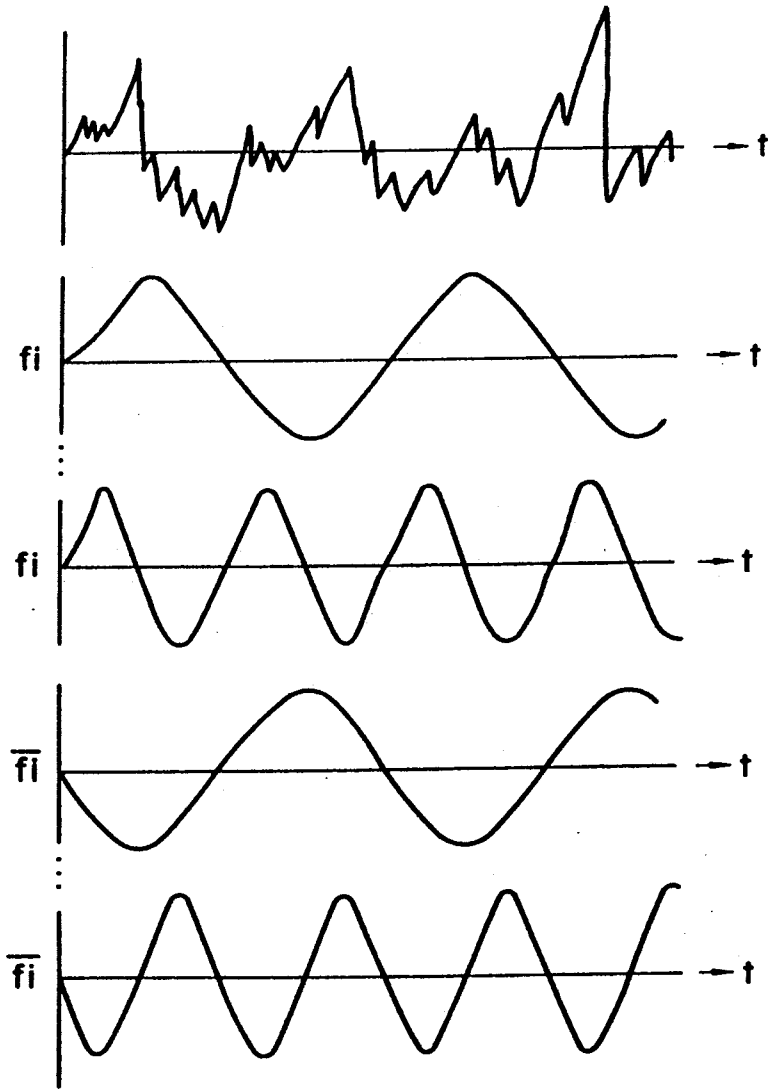
FIGS. 2(A), 2($B_1$), 2($B_i$) 2($C_1$), and 2($C_i$) are views showing the waveform of an output signal of a filter circuit in the device shown in FIG. 1.

The acousto-electric conversion circuit 12 is a known circuit provided with a microphone 22 and an amplifier 24 for amplifying the output signal from the microphone, and for example, outputs an acoustic-electric signal A shown in FIG. 2 mixed with signals of a number of frequencies to the filter circuit 16.

The setting circuit 14, the filter circuit 16 and the phase-shift circuit 18 are provided with a plurality (i) of setters, band-pass filters and phase shifters, respectively. The setters, the band-pass filters and the phase shifters are coordinated with each other.

Each band-pass filter in the filter circuit 16 receives the acoustic-electric signal A from the acoustic-electric conversion circuit 12 and outputs a first electrical signal having the frequency set in the corresponding setter in the received acoustic-electric signal to the corresponding phase shifter. For this reason, the filter circuit 16 outputs the first electrical signals B1 through Bi of the fequencies f1 through fi on the time axis as shown in FIG. 2.

Each phase shifter in the phase-shift circuit 18 outputs a second electrical signal having the same frequency as the frequency of an input signal and the inverted phase to the phase of the input signal by phase-shifting the first electrical signal supplied from the corresponding filter with an angle of approximately 180°. For this reason, the phase-shift circuit 18 outputs second electrical signals C1 through Ci shown in FIG. 2.

The electro-acoustic conversion circuit 20 adds the second electrical signals from the phase-shift circuit 18 in an adder circuit 26, amplifies the resulting output signal in an amplifier 28, and then, converts the outputting signal from the amplifier 28 into a sound by means of a speaker 30.

The device for noise attenuation 10 takes out a signal having the frequency set in the selection circuit 14 from the acousto-electric signal A corresponding to a noise generated from the weaving machine, reverses the phase of the signal thus obtained, electrically synthesizes the reversed signal and converts the synthesized signal into a sound. For this reason, in the noise generated from the weaving machine, the acoustic wave of the frequency set by the selection circuit 14 is cancelled or attenuated by the acoustic wave generated from the speaker 30, and as a result, the noise is attenuated.

The acoustic wave to be attenuated, that is, the frequency set in the frequency selection circuit 14, is preferably of a value most effectively attenuating the noise, for example, it can be the peak frequency.

For avoiding the hindrance of the time delay due to the signal processing by each circuit in the noise attenuation device, it is preferable to place the microphone and the speaker apart from each other so that the noise may be attenuated most effectively taking into consideration the time delay and the speed of sound. Therefore, for example, the microphone can be disposed in the neighborhood of a noise source of the weaving machine, and the speaker can be disposed at a place where the operator is located, e.g., in the neighborhood of a control panel. It is preferable to arrange the speaker so as to place it at the height of the operator's ear position and to direct the acoustic wave toward the operator's ear.

At least one device for noise attenuation may be provided to each weaving machine or at least one device for noise attenuation may be provided to each noise source.

Since the acoustic wave has its directivity, however, it is preferable to dispose a device for noise attenuation provided with each set of microphone and speaker in another direction (e.g., four directions) against each noise source in consideration of the operator's operational position.

As a noise source in the weaving machine, the following things can be listed.

Cam box for driving a shedding motion

Blower apparatus

Nozzles for weft inserting (particularly, jet noise from main nozzle)

Reed beating (colliding sound by reed and woven cloth)

Heald accompanied by the vertical motion of heald frame (moving sound)

The frequency set in the frequency selection circuit 14 may be a preliminarly determined value, may set by selecting such value to minimize noise while the operator is checking the noise, or may be automatically set so as to minimize noise while the operator is electrically analyzing the noise.

Figure 3:
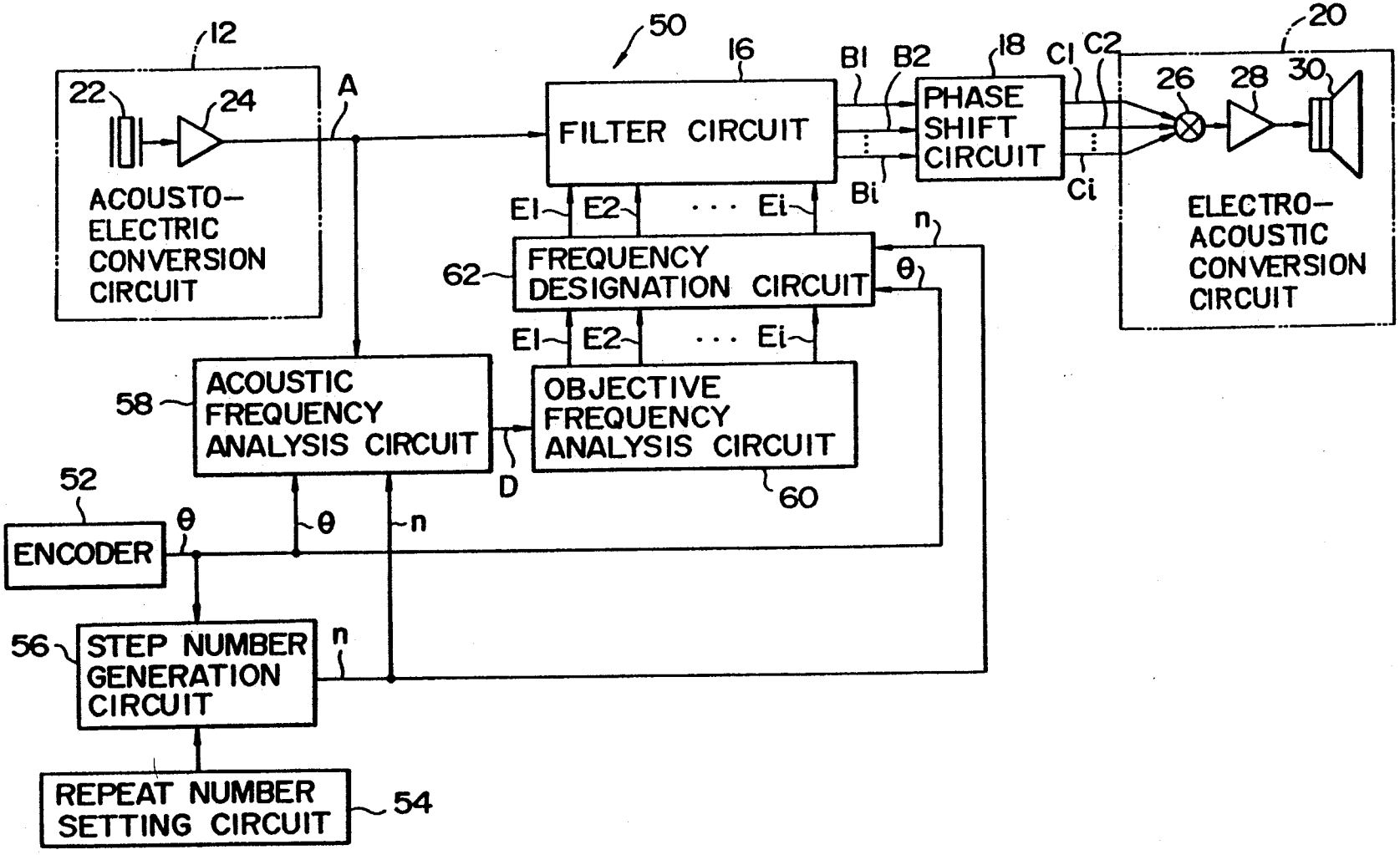
FIG. 3 is a block diagram showing an electrical circuit of a device for noise attenuation as another embodiment of the present invention.

FIG. 3 shows a device for noise attenuation 50 for automatically determining and setting the frequency of a sound to be attenuated depending on fabric texture.

The device for noise attenuation 50 comprises first signal generation means, that is, an encoder 52 for generating an electrical timing signal $\theta$ corresponding to the rotating angle of a main shaft of a weaving machine, instead of the frequency selection circuit 14, means, that is, a repeat number selection circuit 54 for setting the repeat number of the woven pattern of a woven fabric, second signal generation means, that is, a step number signal generating circuit 56 for generating an electrical step number signal n corresponding to the present step in one repeat, third signal processing means, that is, an acoustic frequency analysis circuit 58 for analyzing the frequency of an acousto-electric signal A and outputting a predetermined electrical signal D, fourth signal processing means, that is, an objective frequency analysis circuit 60 for outputting electrical signals E1 through Ei specifying the frequency of an acoustic wave to be attenuated in the acousto-electric signal A, and fifth signal processing means, that is, a frequency designation circuit 62 for preliminarily storing the electrical signal E1 through Ei, reading out the electrical signals E1 through Ei at the time of weaving, and outputting the read-out electrical signals to the filter circuit 16.

The timing signal $\theta$ is information for specifying the angle while the main shaft of the weaving machine turns one revolution, and is outputted to the step number signal generation circuit 56, the acoustic frequency analysis circuit 58 and the frequency designation circuit 62, respectively.

The repeat number signal is the pattern of fabrics, that is, one circulation (total step number) of heald frame selection pattern or weft selection pattern and is set up by a digital switch or the like.

A step number signal n is a so-called step number signal expressing a weft inserting sequence when a woven pattern is woven, and is generated by use of the timing signal $\theta$ and the repeat number signal. For example, the step number signal n can be an arbitrary integer from 1 to n which advances by 1 step every time the main shaft of the weaving machine turns one revolution, that is, one time of weft inserting is carried out, and which returns to 1 every time the number of revolutions of the main shaft of the weaving machine becomes a set repeat number (n), that is, the weaving having a woven pattern is over. The step number signal n is supplied to the acoustic frequency analysis circuit 58 and the objective frequency analysis circuit 62.

The acoustic frequency analysis circuit 58 is operated at the time of test drive for the frequency analysis of the actual acousto-electric signal A when the weaving machine is operated prior to the initiation of the original control of the noise attenuation device 50.

The acoustic frequency analysis circuit 58 analyzes the frequency and the amplitude of the acousto-electric signal A with respect to each step in a woven pattern per the rotating angle of the main shaft of the weaving machine on the basis of the acousto-electric signal A, the timing signal $\theta$ and the step number signal n, and outputs the electrical signal D corresponding to the analyzed frequency f and amplitude a by relating the electrical signal D with the angle of rotation (timing signal $\theta$) of the main shaft and the step number (step number signal n). A FFT analyzer can be used as such an acoustic frequency analysis circuit 58.

Figure 4:
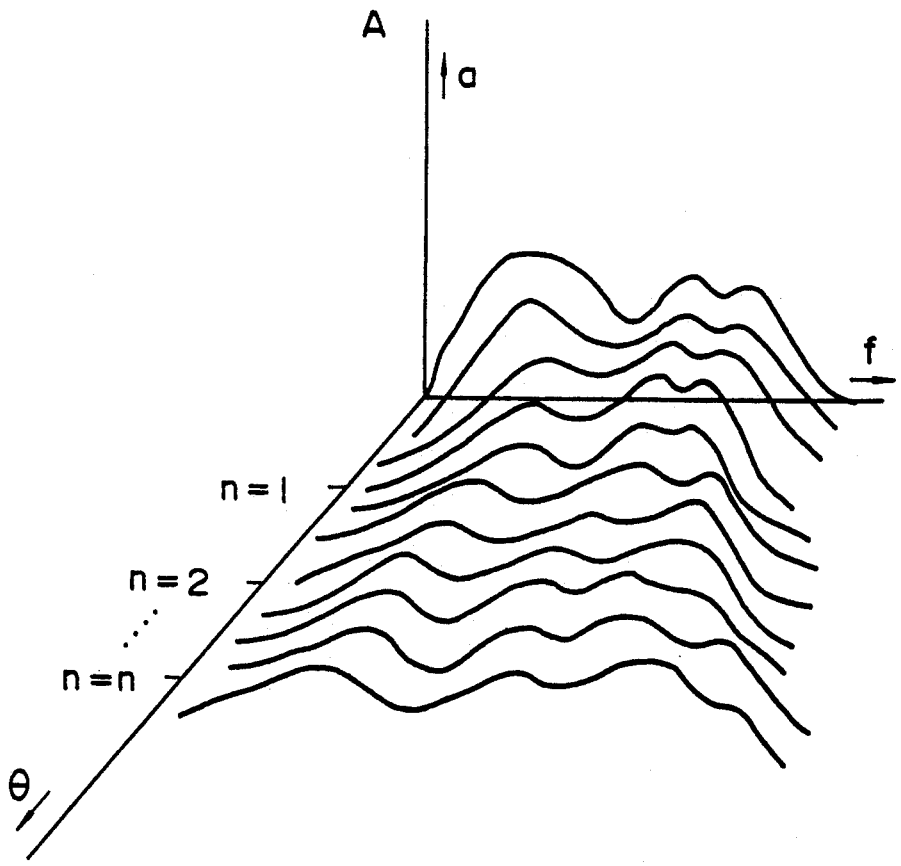
FIG. 4 is a view showing the waveform of an output signal of an acoustic frequency analysis circuit in the device shown in FIG. 3.

An embodiment of the electrical signal D outputted from the acoustic freqeuncy analysis circuit 58 is shown in FIG. 4. The electrical signal D shown in FIG. 4 is an analog signal, but it is preferable that the electrical signal D be a binary coded digital signal.

The objective frequency analysis circuit 60 is a circuit for analyzing an acoustic wave to be attenuated in the acousto-electric signal A with respect to each step of a woven pattern per the angle of rotation of the main shaft of the weaving machine on the basis of the electrical signal D outputted from the acoustic frequency analysis circuit 58, and outputting the electrical signals E1 through Ei corresponding to the frequency and amplitude of the analyzed acousto-electric wave by relating these electrical signals with the angle of rotation (namely, timing signal $\theta$) of the main shaft and the step number (namely, step number signal n).

The electrical signal E1 through Ei outputted from the objective frequency analysis circuit 60 can be a largest peak frequency E1, a second largest peak frequency E2, and an i-th largest peak frequency Ei when the repeat number is n and the angle of rotation is $\theta$. These electrical signals E1 through Ei correspond to the individual filters of i numbers within the filter circuit 16.

The frequency designation circuit 62 stores the electrical signals E1 through Ei by relating these electrical signals with the timing signal $\theta$ and the step number signal n as shown in FIG. 5. In an embodiment shown in FIG. 5, the step number signal varies from 1 to n, and the timing signal $\theta$ varies from $\theta 1$ to $\theta m$. The peaks 1, 2 and i show the first largest peak frequency, the second largest peak frequency and the i-th largest peak frequency, respectively. In the figure, the frequencies at the peaks 1, 2 and i when the step number signal is n and the timing signal is θm are expressed as f1nm, f2nm and finm, respectively.

When the device for noise attenuation 50 is originally controlled, the frequency designation circuit 62 reads out the electrical signals E1 through Ei showing their respective frequencies of the peaks 1, 2 and i per the timing signal θ and the step number signal n on the basis of the timing signal θ and the step number signal n, and then outputs the read-out electrical signals E1 through Ei to the filter circuit 16.

The respective electrical signal E1 through Ei read out from the frequency designation circuit 62 are supplied to the corresponding filters to the filter circuit 16 as the signals for designating the passing bands of the frequencies, respectively.

In this manner, the noise attenuation device 50 preliminarily determines the frequency of an acoustic wave to be attenuated at the test drive time, stores such frequency in the frequency designation circuit 62, reads out such frequency at its original control time, and supplies such frequency to the filter of the filter circuit 16 as a signal for designating the pass band of its frequency.

Therefore, according to the noise attenuation device 50, of all the noise generated by the weaving machine, the acoustic wave of the corresponding frequency to each of the electrical signals E1 through Ei outputted from the frequency designation circuit 62 are cancelled or attenuated by the acoustic waves generated from the speaker 30, resulting in the attenuation of the noise.

Figure 6:
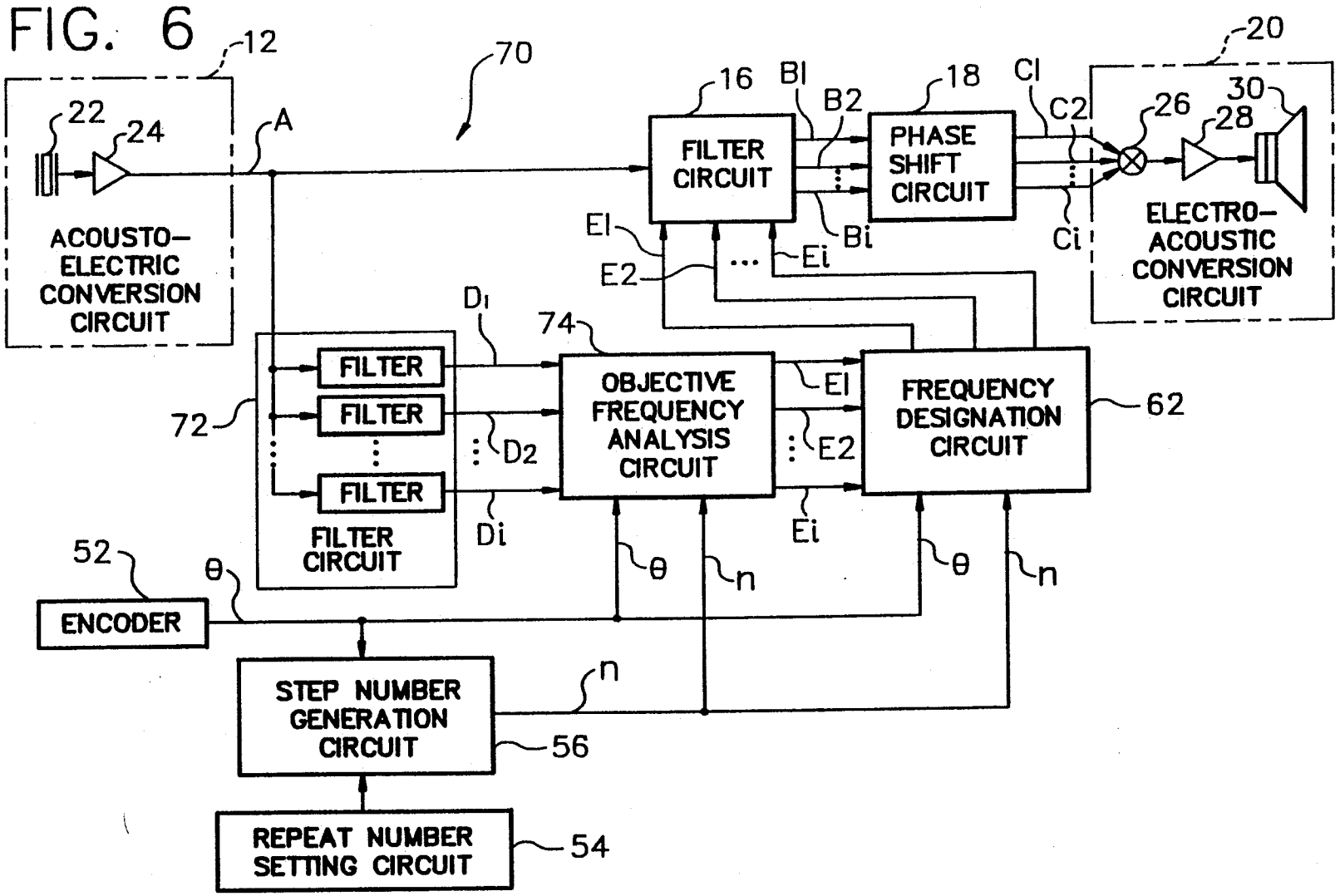
FIG. 6 is a block diagram showing an electrical circuit of a device for noise attenuation as a further embodiment of the present invention.

A device for noise attenuation 70 shown in FIG. 6 comprises third signal processing means, that is, a filter circuit 72 for outputting electrical signals D1 through Di of a predetermined frequency component in an acoustic signal A, instead of the acousto-electric frequency analysis circuit 58, and fourth signal processing means, that is, an objective frequency analysis circuit 74 for outputting electrical signals E1 through Ei for specifying the frequency of the acoustic wave to be attenuated in the acousto-electric signal A on the basis of the electrical signal D1 through Di, the timing signal θ and the step number signal n, instead of the objective frequency analysis circuit 60.

Figures 7A, 7B, 7C, 7I:
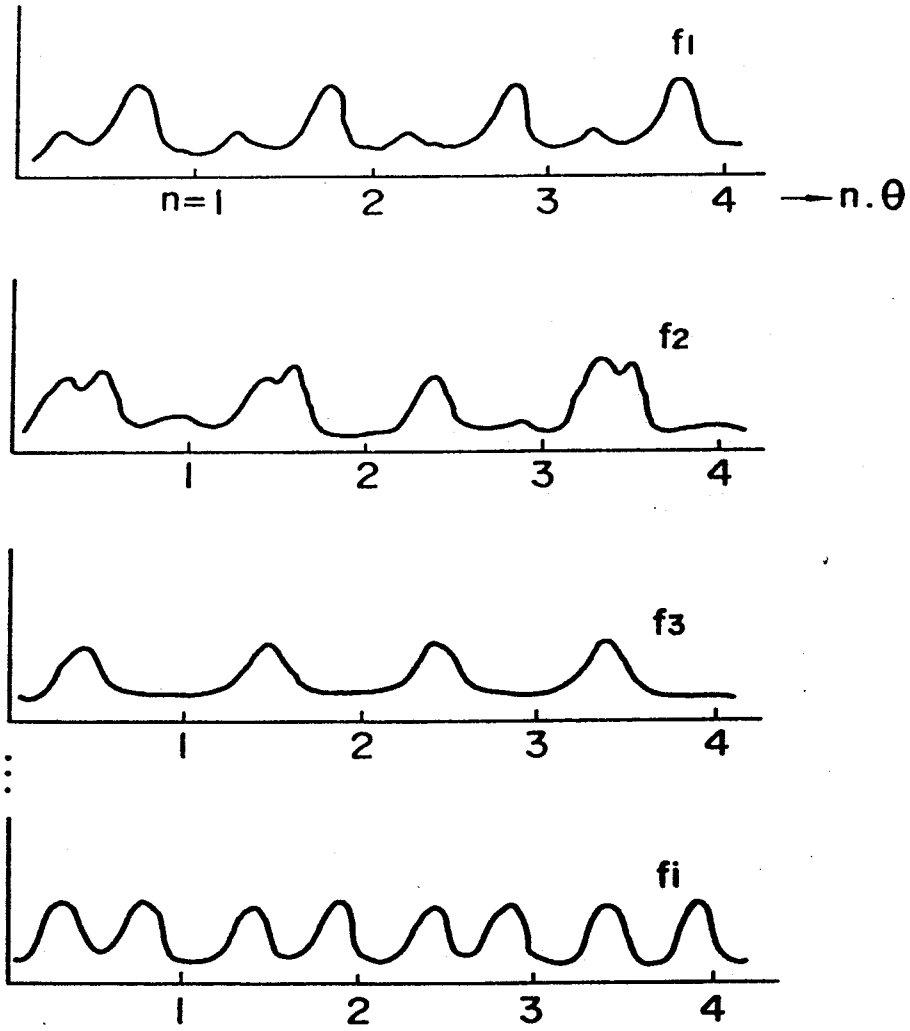
FIGS. 7(A), 7(B), 7(C), and 7(I) are views showing the waveform of an output signal of a filter circuit in the device shown in FIG. 6.

The filter circuit 72 is provided with a plurality (n) of filters individually corresponded to the band-pass filters of the filter circuit 16 or more than the band-pass filters of the filter circuit 16. The pass bands of the filters of the filter circuit 72 are mutually different. In accordance with the set pass bands of the filter circuit 72, for example, the signals having waveforms shown by (A), (B), (C) and (I) in FIG. 7 are outputted from the filter circuit 72 to the objective frequency analysis circuit 74.

The objective frequency analysis circuit 74 analyzes the electrical signals each having a first largest amplitude, a second largest amplitude and an i-th largest amplitude from the electrical signals D1 through Di per the timing signal θ in the step number signal n on the basis of the electrical signals D1 through Di supplied from the filter circuit 72, the timing signal θ and the step number signal n, and generates a frequency corresponding to the pass band of each filter of these electrical signals as the electrical signal E1 through Ei by relating these electrical signals with the step number signal n and the timing signal θ.

In similar way as in the preceding embodiment, the frequency designation circuit 62 stores the input electrical signals E1 through Ei by relating these electrical signals with the timing signal θ and the step number signal n as shown in FIG. 5.

In this manner, the device for noise attenuation 70 preliminarily determines the frequency of an acoustic wave to be attenuated, stores the frequency in the frequency designation circuit 62, reads out the frequency at its original control time and supplies the read-out frequency to the filters in the filter circuit 16 as a signal for designating its pass band.

Therefore, according to the noise attenuation device 70, the acoustic wave of the corresponding frequency to each of the electrical signals E1 through Ei outputted from the frequency designation circuit 62 of all the noises generated from the weaving machine is cancelled or attenuated by the acoustic wave generated by the speaker 30, resulting in the noise attenuation.

In the noise attenuation device 50, since the electrical signals E1 through Ei are preliminarily stored in the frequency designation circuit 62 and read out at its original control time, the acoustic frequency analysis circuit 58 and the objective frequency analysis circuit 60 may be stopped or operated every predetermined period of time during the weaving operation. From the same reason, also in the noise attenuation device 70, the filter circuit 72 and the objective frequency analysis circuit 74 may be stopped at their original control time or operated every predetermined period of time. This is, in general, due to the fact that the frequency of the acoustic wave from the weaving machine does not vary in a short period of time.

The acoustic wave to be attenuated preferably has plural frequencies as shown in the illustrated embodiment, but it may be one. In case of attenuating one acoustic wave, the frequency selection circuit, the filter circuit and the phase-shift circuit are each provided with a frequency selector, a band phase filter and a phase shifter, respectively.

In the embodiment shown in FIGS. 3 and 6, it is not necessary to consider any woven patterns such as a heald frame selection pattern. Namely, in case where the acoustic wave to be attenuated is generated irrespective of these woven patterns, in the case of a single colored weft inserting device, or in the case where the heald frame selection pattern is a plan texture, there is no need for considering any woven patterns. In these cases, the repeated number selection circuit 54 and the step number signal generation circuit 56 are not needed, and the signals E1 through Ei are generated, stored and read out by relating these signals with the angle of rotation of the main shaft of the waving machine, that is, the timing signal θ.

Figure 8:
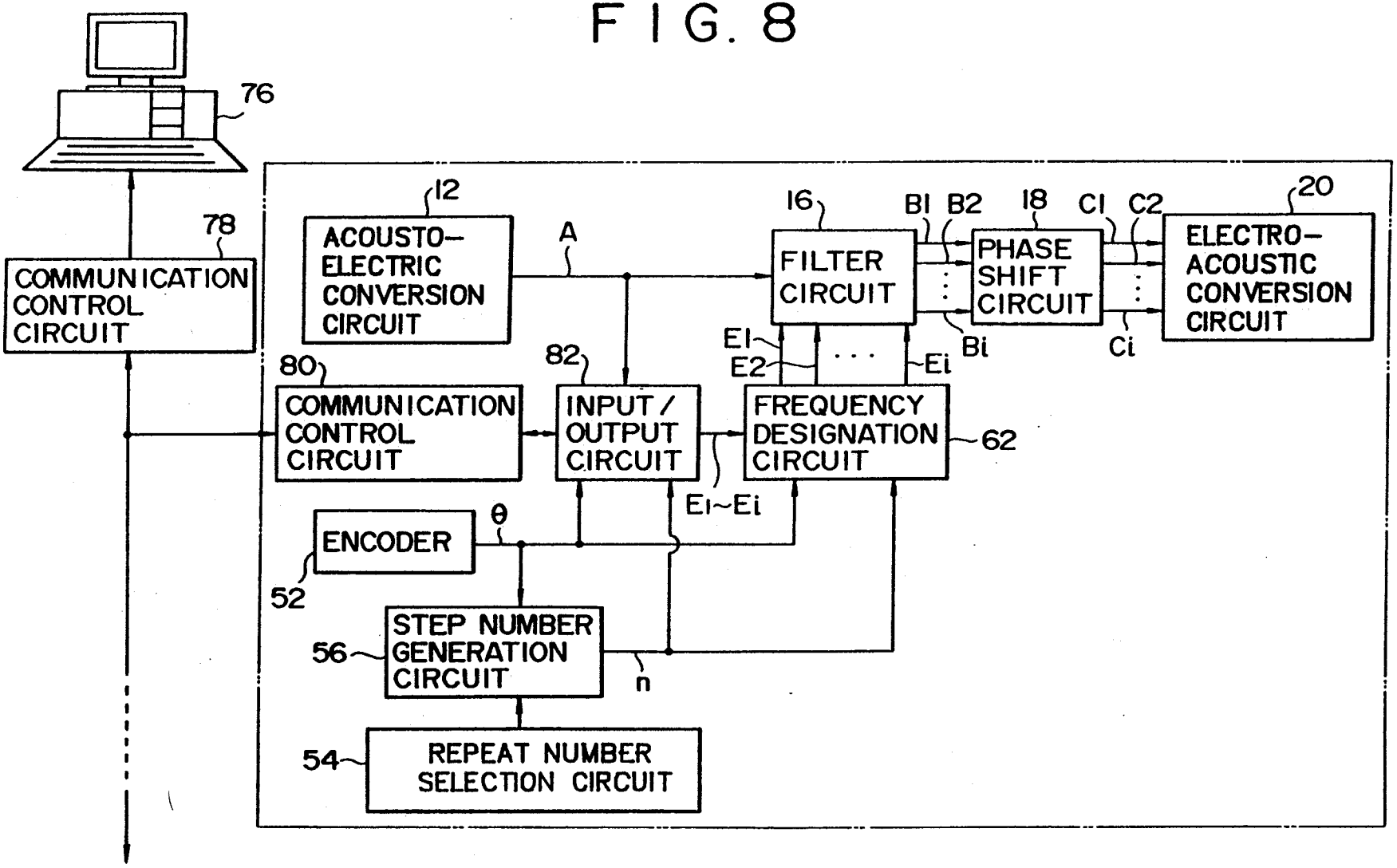
FIG. 8 is a block diagram showing an electrical circuit of a device for noise attenuation as a still further embodiment of the present invention.

Furthermore, in case of controlling a plurality of weaving machines by a host computer used in common, the function for determining an acoustic wave to be attenuated, e.g., the functions for the acoustic frequency analysis circuit 58 and the objective analysis circuit 60, may be carried out by a host computer 76 as shown in FIG. 8.

In FIG. 8, a communication control circuit 78 is provided at the side of the host computer 76. On the other hand, a communication control circuit 80 and an input/output circuit 82 are provided at the side of each terminal unit, instead of the acoustic frequency analysis circuit 58 and the objective frequency analysis circuit 74 or the filter circuit 72 and the objective frequency analysis circuit 60.

The acoustic signal A, the timing signal $\theta$ and the step number signal n are transmitted to the host computer 76 through the input/output circuit 82 and the communication control circuits 80 and 78. Then, the host computer 76 analyzes an acoustic wave to be attenuated and outputs the electrical signal E1 through Ei corresponding to the frequencies of the analyzed acoustic waves to the side of the terminal unit through the communication control circuit 78 by relating these electrical signals with the timing signal $\theta$ and the step number signal n. The electrical signals E1 through Ei transmitted to the terminal unit are stored in the frequency designation circuit 62.

In the embodiment shown in FIG. 8, the repeat number selection circuit 54 may be provided at the side of the host computer 76.

Furthermore, for the purpose of storing the electrical signals E1 through Ei by relating these electrical signals with the timing signal $\theta$ and the step number signal n in the frequency designation circuit 62, reading out these electrical signals E1 through Ei by relating these electrical signals with the timing signal $\theta$ and the step number signal n at their original control time, and outputting the read-out electrical signals to the filter circuit 16, for example, it may be constructed by storing the electrical signals E1 through Ei in an address specified by the timing signal $\theta$ and the step number signal n, reading out a signal within the address specified by the timing signal $\theta$ and the step number signal n at the reading out time, and outputting the read-out electrical signals to the filter circuit 16.

What is claimed is:

1. A device for noise attenuation of a weaving machine comprising:

first conversion means for receiving a sound and outputting an acousto-electric signal corresponding to said sound;

sound specifying means for generating a sound specifying signal for specifying a sound to be attenuated;

first signal processing means for receiving said acousto-electric signal and outputting a first electrical signal having the frequency and amplitude corresponding to a sound to be specified by said sound specifying signal by using the received acousto-electric signal;

second signal processing means for receiving said first electrical signal and outputting a second electrical signal having the same frequency and an inverted phase relative to the received first electrical signal; and second conversion means for receiving said second electrical signal and generating a sound corresponding to the received second electrical signal;

wherein said sound specifying means includes:

means for generating an electrical timing signal corresponding to the angle of rotation of the main shaft of the weaving machine;

third signal processing means for receiving said acousto-electric signal and outputting a third electrical signal corresponding to the received acousto-electric signal, the third electrical signal being related with said timing signal; and fourth signal processing means for receiving said third electrical signal, storing the received third electrical signal, the received third electrical signal being related with said timing signal, reading out the stored third electrical signal on the basis of said timing signal, and outputting said sound specifying signal to said first signal processing means on the basis of the read-out third electrical signal.

2. A device according to claim 1, wherein said third signal processing means includes a first processing circuit for outputting a signal corresponding to the frequency and amplitude of said received acousto-electric signal by relating the received acousto-electric signal with said timing signal, and a second processing circuit for receiving the output signal of said first processing circuit and outputting said third electrical signal, said third electrical signal being related with said timing signal on the basis of the received output signal from the first processing circuit.

3. A device according to claim 1, wherein said third signal processing means includes a first processing circuit for outputting a signal of a predetermined frequency component in said received acousto-electric signal, and a second processing circuit for receiving the output signal of said first processing circuit and outputting said third electrical signal, said third electrical signal being related with said timing signal on the basis of the received output signal from the first processing circuit.

4. A device according to claim 1, wherein said sound specifying means further includes means for setting a repeat number of a woven pattern, and means for generating an electrical step number signal corresponding to a step number of said woven pattern on the basis of said timing signal and the set repeat number;

wherein said third signal processing means includes a first processing circuit for outputting a signal corresponding to the frequency and amplitude of the received acousto-electric signal by relating the received acousto-electric signal with said timing signal and said step number signal, and a second processing circuit for receiving the output signal of said first processing circuit and outputting said third electrical signal on the basis of the received output signal from the first processing circuit; and wherein said fourth signal processing means stores the received third electrical signal, the received third electrical signal being related with said timing signal and said step number signal, reads out the stored third electrical signal by using said timing signal and said step number signal, and outputs said sound specifying signal to said first signal processing means on the basis of the read-out third electrical signal.

5. A device according to claim 1, wherein said sound specifying means further includes means for setting a repeat number of a woven pattern, and second signal generation means for generating an electrical step number signal corresponding to a step number signal of said woven pattern on the basis of said timing signal and said repeat number every time said main shaft makes one revolution, wherein said third signal processing means includes a first signal processing circuit for outputting a signal of a predetermined frequency component in the received acousto-electric signal, and a second processing circuit for receiving the output signal of said first processing circuit and outputting said third electrical signal, said third electrical signal being related with said timing signal and said step number signal on the basis of the received output signal from the first processing circuit; and wherein said fourth signal processing means stores said received third electrical signal, said received third electrical signal being related with said timing signal and said step number signal, reads out the stored third electrical signal by using said timing signal and said step number signal, and outputs said sound specifying signal to said first signal processing means on the basis of the read-out third electrical signal.

6. A device for noise attenuation comprising:

first conversion means for receiving a sound and outputting an acousto-electric signal corresponding to the received sound;

first signal processing means for receiving said acousto-electric signal and outputting a first electrical signal having the frequency and amplitude corresponding to a sound to be attenuated in the received acousto-electric signal;

second signal processing means for receiving said first electrical signal and outputting a second electrical signal having the frequency and an inverted phase relative to said first electrical signal;

second conversion means for receiving said second electrical signal and generating a sound corresponding to the received second electrical signal;

first signal generation means for generating an electrical timing signal corresponding to the angle of rotation of the main shaft of a weaving machine;

third signal processing means for receiving said acousto-electric signal and outputting a third electrical signal corresponding to the frequency and amplitude of the received acousto-electric signal, the third electric signal being related with said timing signal;

fourth signal processing means for receiving said third electrical signal and outputting a fourth electrical signal specifying the frequency of a sound to be attenuated on the basis of the acousto-electric signal, the fourth electrical signal being related with said timing signal; and fifth signal processing means for receiving said fourth electrical signal, storing the received fourth electrical signal, said received fourth electrical signal being related with said timing signal, reading out the stored fourth electrical signal on the basis of said timing signal and outputting the read-out fourth electrical signal to said first signal processing means;

wherein the frequency of said first electrical signal outputted from said first signal processing means is specified by said fourth electrical signal outputted from said fifth signal processing means.

7. A device for noise attenuation comprising:

first conversion means for receiving a sound and outputting an acousto-electric signal corresponding to said sound;

first signal processing means for receiving said acousto-electric signal and outputting a first electrical signal having the frequency and amplitude corresponding to a sound to be attenuated on the basis of the received acousto-electric signal;

second signal processing means for receiving said first electrical signal and outputting a second electrical signal having the same frequency and an inverted phase relative to the received first electrical signal;

second conversion means for receiving said second electrical signal and generating a sound corresponding to the received second electrical signal;

first signal generation means for generating an electrical timing signal corresponding to the angle of rotation of the main shaft of a weaving machine;

third signal processing means for receiving said acousto-electric signal and outputting a third electrical signal of a predetermined frequency component in the received acousto-electric signal;

fourth signal processing means for receiving said third electrical signal and outputting a fourth electrical signal specifying the frequency corresponding to a sound to be attenuated in said acousto-electric signal, said fourth electrical signal being related with said timing signal; and fifth signal processing means for receiving said fourth electrical signal, storing the received fourth electrical signal, said received fourth electrical signal being related with said timing signal, reading out the stored fourth electrical signal on the basis of said timing signal, and outputting the read-out fourth electrical signal to said first signal processing means;

wherein the frequency of said first electrical signal outputted from said first signal processing means is specified by said fourth electrical signal outputted from said fifth signal processing means.

8. A device for noise attenuation comprising:

first conversion means for receiving a sound and outputting an acousto-electric signal corresponding to said sound;

first signal processing means for receiving said acousto-electric signal and outputting a first electrical signal having the frequency and amplitude corresponding to a sound to be attenuated on the basis of the received acousto-electric signal;

second signal processing means for receiving said first electrical signal and outputting a second electrical signal having the frequency and an inverted phase relative to the received first electrical signal;

second conversion means for receiving said second electrical signal and generating a sound corresponding to the received second electrical signal;

first signal generation means for generating an electrical timing signal corresponding to the angle of rotation of the main shaft of a weaving machine;

means for setting a repeat number of a woven pattern;

second signal generation means for generating an electrical step number signal corresponding to a step number of said woven pattern on the basis of said timing signal and a set repeat number;

third signal processing means for receiving said acousto-electric signal and outputting a third electrical signal corresponding to the frequency and amplitude of the received acousto-electric signal, said third electrical signal being related with said timing signal and said step number signal;

fourth signal processing means for receiving said third electrical signal and outputting a fourth electrical signal specifying the frequency of a sound to be attenuated on the basis of the acousto-electric signal, said fourth electrical signal being related with said timing signal and said step number signal; and fifth signal processing means for receiving said fourth electrical signal, storing the received fourth electrical signal, the received fourth electrical signal being related with said timing signal and said step number signal, reading out said fourth electrical signal by using said timing signal and said step number signal, and outputting said read-out fourth electrical signal to said first signal processing means;

wherein the frequency of said first electrical signal outputted from said first signal processing means is specified by said fourth electrical signal outputted from said fifth signal processing means.

9. A device for noise attenuation comprising:

first conversion means for receiving a sound and outputting an acousto-electric signal corresponding to said sound;

first signal processing means for receiving said acousto-electric signal and outputting a first electrical signal having the frequency and amplitude corresponding to a sound to be attenuated on the basis of the received acousto-electric signal;

second signal processing means for receiving said first electrical signal and outputting a second electrical signal having the same frequency and inverted phase relative to the received first electrical signal;

second conversion means for receiving said second electrical signal and generating a sound corresponding to the received second electrical signal;

first signal generation means for generating an electrical timing signal corresponding to the angle of rotation of the main shaft of a weaving machine;

means for setting a repeat number of a woven pattern;

second signal generation means for generating an electrical step number signal corresponding to the step number of said woven pattern on the basis of said timing signal and the set repeat number;

third signal processing means for receiving said acousto-electric signal and outputting a third electrical signal of a predetermined frequency component in the received acousto-electric signal;

fourth signal processing means for receiving said third electrical signal and outputting a fourth electrical signal specifying the frequency corresponding to a sound to be attenuated in said acousto-electric signal, the fourth electrical signal being related with said timing signal and said step number signal; and fifth signal processing means for receiving said fourth electrical signal, storing the received fourth electrical signal, said received fourth electrical signal being related with said timing signal and said step number, reading out the stored fourth electrical signal by using said timing signal and said step number signal, and outputting the read-out fourth electrical signal to said first signal processing means;

wherein the frequency of said first electrical signal outputted from said first signal processing means is specified by said fourth electrical signal outputted from said fifth signal processing means.

* * * * *